US007465154B2

(12) United States Patent
Devore et al.

(10) Patent No.: US 7,465,154 B2
(45) Date of Patent: Dec. 16, 2008

(54) GAS TURBINE ENGINE COMPONENT SUCTION SIDE TRAILING EDGE COOLING SCHEME

(75) Inventors: Matthew Devore, Manchester, CT (US); Corneil Paauwe, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 353 days.

(21) Appl. No.: 11/405,881

(22) Filed: Apr. 18, 2006

(65) Prior Publication Data

US 2007/0243065 A1 Oct. 18, 2007

(51) Int. Cl.
*F01D 5/18* (2006.01)

(52) U.S. Cl. ..... 416/97 R; 415/115

(58) Field of Classification Search ..... 415/115; 416/97 R

See application file for complete search history.

(56) References Cited

U.S. PATENT DOCUMENTS 4,297,077 A * 10/1981 Durgin et al. ..... 416/97 R
5,711,650 A * 1/1998 Tibbott et al. ..... 415/115
6,652,220 B2 * 11/2003 Powis et al. ..... 415/1
6,932,568 B2 * 8/2005 Powis et al. ..... 415/189

* cited by examiner

*Primary Examiner*—Igor Kershteyn
(74) *Attorney, Agent, or Firm*—Carlson, Gaskey & Olds

(57) ABSTRACT

A gas turbine engine component has a cooling scheme that utilizes an impingement tube to cool the suction wall and the pressure wall of a mid portion of an airfoil. The impingement tube is formed to not have impingement holes on an end of the impingement tube spaced toward the trailing edge along the suction wall. Impingement holes are formed in the same portion on a side of the impingement tube facing the pressure wall. Pedestals extend from an inner face of the suction wall toward the impingement tube in this area. The use of the pedestals over this area provides greater cooling to a focused area on the suction wall of the airfoil that might otherwise receive inadequate film cooling.

18 Claims, 5 Drawing Sheets

GAS TURBINE ENGINE COMPONENT SUCTION SIDE TRAILING EDGE COOLING SCHEME

This invention was made with government support under Contract No. N-00019-02-C-3003 awarded by the United States Navy. The government therefore has certain rights in this invention.

BACKGROUND OF THE INVENTION

This application relates to a cooling scheme for a gas turbine engine component, such as a stationary vane, wherein an impingement tube is located within a cooling air channel, and pedestals are aligned with a portion of the tube.

Gas turbine engines are provided with a number of functional sections, including a fan section, a compressor section, a combustion section, and a turbine section. Air and fuel are combusted in the combustion section. The products of the combustion move downstream, and pass over a series of turbine rotors, driving the rotors to create power.

Numerous components within the gas turbine engine are subject to high levels of heat during operation. As an example, a turbine section will have a plurality of vanes over which high temperature products of combustion pass. Cooling fluid, and typically air, is passed within a body of the vanes to cool the vanes.

A number of approaches have been made to cool the stationary vanes. One type of cooling is film cooling. In film cooling, air is directed from an internal cavity in the vane to an outer surface. This air creates a film passing along the outer surface, and is much cooler than the products of combustion. The film cooling thus cools an outer surface of the vane. For various reasons, the location and amount of film cooling may be limited.

Other cooling schemes include the use of impingement air being directed through an impingement tube and off of an inner wall of the vane. The purpose of this impingement cooling air flow is to cool the inner wall.

In one particular cooling scheme arrangement known for vanes, an impingement tube directs air through impingement holes and against inner walls of the vane at both a suction side and a pressure side. The impingement tube is positioned in a mid-location between a cavity rib and a pedestal array. Air having passed through impingement holes at both the pressure side and the suction side, then passes downstream between the impingement tube and an inner wall, and then over the trailing edge pedestal array the air exits through exit holes at the trailing edge. Further, a film cooling hole is provided on the suction side forwardly of a gage point. This position is utilized to reduce certain aerodynamic losses. The air having left this film cooling hole passes along the suction side to cool the wall. However, the cooling provided by this film cooling air degrades along a direction toward the trailing edge. Thus, and in an area roughly adjacent with an end of the impingement tube area, there is a portion of the suction wall that may not receive adequate cooling.

In addition to this degradation, the impingement in this region also becomes somewhat ineffective due to "cross-flow degradation." This is the result of the accumulation of coolant that has been injected from earlier regions. As more flow enters the cavity between the tube and the wall and heads toward the trailing edge, the impingement jets begin to become less effective.

The present invention is directed to addressing this concern.

SUMMARY OF THE INVENTION

In a disclosed embodiment of this invention, a cooling channel is formed within a gas turbine component. The gas turbine component is disclosed as a stationary vane, although other components such as turbine blades, etc., which utilize impingement tubes, can benefit from this invention. Impingement air is directed outwardly of the impingement tube against inner walls of a component body at both the suction side and the pressure side. Impingement air passes downwardly of the impingement tube, and over pedestals toward exit holes at a trailing edge of the turbine component.

To improve cooling in the area mentioned above, supplemental pedestals extend from an inner wall at the suction side and toward the impingement tube. In a disclosed embodiment, there are no impingement holes formed in the impingement tube over the length of the impingement tube that has the supplemental pedestals. Impingement holes are formed in the tube at the pressure side along the same length.

In addition, the geometries of the tube, the channel, and the sizing of the various holes are controlled such that the volume of air passing outwardly of the impingement holes at the suction side which reaches the trailing edge, compared to the volume of air having passed through impingement holes at the pressure side which reaches the trailing edge, is greater than 5:1. In this manner, a good deal of additional cooling is provided to the suction side, thus addressing the concern mentioned above.

In other features, the supplemental pedestals increase in height in a direction from the leading edge toward the trailing edge. Further, the impingement tube is spaced from the inner wall of the suction side by a greater distance as the impingement tube extends from a leading edge end toward a trailing edge end. In this manner, more air flow is directed along the suction side and over the supplemental pedestals, providing greater cooling.

One main function of having the pedestals increase in height is to increase convective surface area and increase fin efficiency. This same effect could be achieved with trip strips or dimples. In fact, the term "pedestals" as utilized in this application and in the claims, extends to more than the cylindrical-shaped elements that are illustrated in the drawings of this application. The term "pedestals" would extend to any structure extending outwardly of the wall and into the flow path. The longer pedestals also serve to push the downstream end of the impingement tube toward the pressure side wall. This limits the area in which flow can enter the trailing edge via the pressure side, providing a seal between the two regions. Another function is to allow the suction side flow to diffuse into the trailing edge pedestal bank. This effect "guides" the air into the wider trailing edge cavity and increases static pressure in the transition region. This static pressure increase also helps to seal off the pressure side flow from entering the trailing edge.

These and other features of the present invention can be best understood from the following specification and drawings, the following of which is a brief description.

DETAILED DESCRIPTION OF THE PREFERRED EMBODIMENT

Figure 1A:
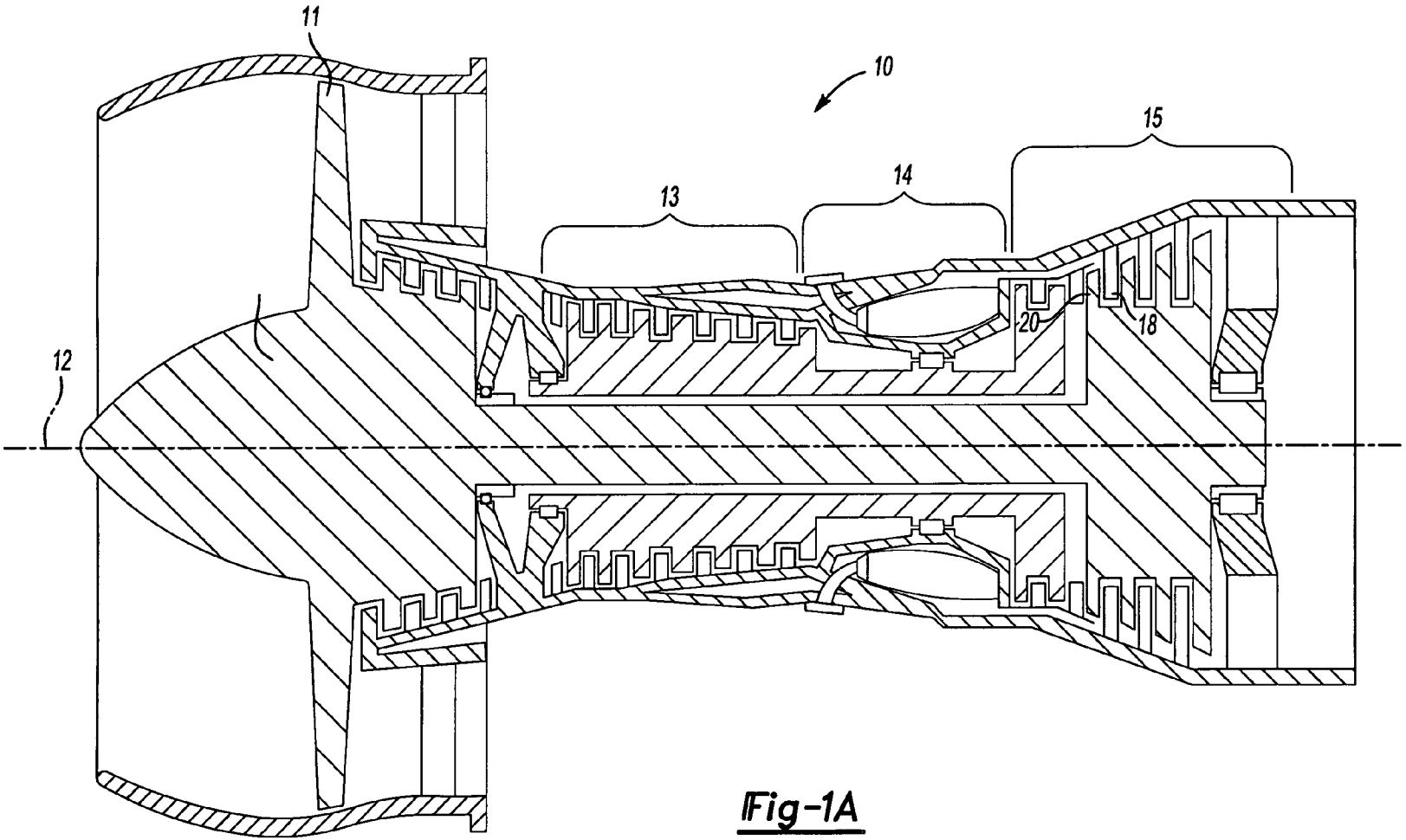
Fig-1A PRIOR ART
FIG. 1A is a schematic view of a prior art gas turbine engine.

FIG. 1A shows a gas turbine engine 10. As known, a fan section 11 moves air and rotates about an axial center line 12. A compressor section 13, a combustion section 14, and a turbine section 15 are also centered on the axial center line 12. FIG. 1A is a highly schematic view, however, it does show the main components of the gas turbine engine. Further, while a particular type of gas turbine engine is illustrated in this figure, it should be understood that the present invention extends to other types of gas turbine engines.

The turbine section 15 includes a rotor having turbine blades 20, and stationary vanes 18. As mentioned above, these turbine blades 20 and vanes 18 become quite hot as the products of combustion pass over them to create power. The present invention is directed to cooling schemes for better cooling such components.

Figure 1B:
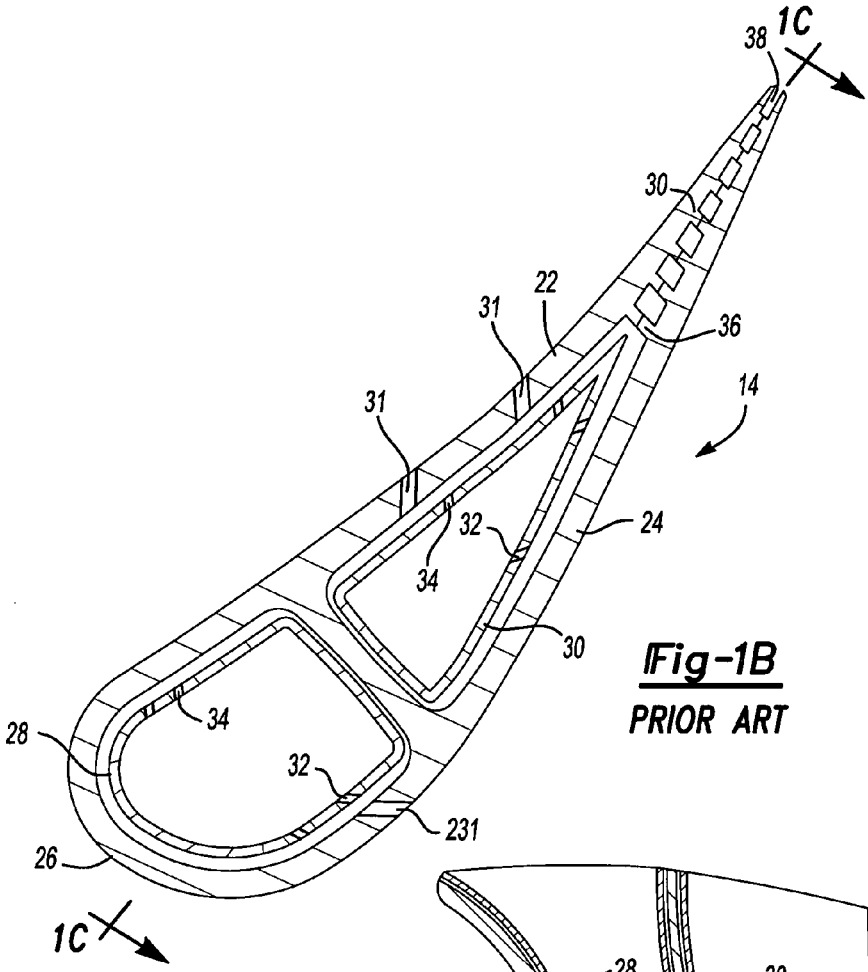
Fig-1B PRIOR ART
FIG. 1B is a cross-sectional view through a prior art stationary vane.

A gas turbine engine component is illustrated in FIG. 1B, as a stationary vane. However, it should be understood that the present invention would extend to other components having impingement tube cooling, including but not limited to turbine blades.

As shown, the vane 18 has an airfoil shape with a pressure side 22 and a suction side 24. Further, the airfoil extends from a leading edge 26 toward a trailing edge 38. An impingement tube 28 is positioned within a cooling air channel adjacent the leading edge. A second impingement tube 30 is positioned spaced toward the trailing edge from the first impingement tube 28. Air is directed outwardly of the tubes 28 and 30, through impingement holes 32 (on the suction side) and 34 (on the discharge side). Air having passed outwardly of these impingement tubes strikes an inner wall at both the pressure side 22 and suction side 24. Air passes outwardly of film cooling holes 31 on the pressure side, to cool a mid-location on the pressure side.

As shown in FIG. 1B, there is a film cooling hole 231 on the suction side, and forward of an approximate location of a gage point. Film cooling air moves along the outer face of the suction side 24 and toward the trailing edge 38.

Pedestals 36 are positioned in a cooling channel that receives the impingement tube 30. Air that has passed outwardly of the impingement holes 32 and 34, and which has not passed outwardly of the film cooling hole 31, passes downstream over these pedestals 36 to cool the trailing edge end of the vane 18. Eventually, the air will pass outwardly of exit holes formed at the trailing edge 38.

Figure 1C:
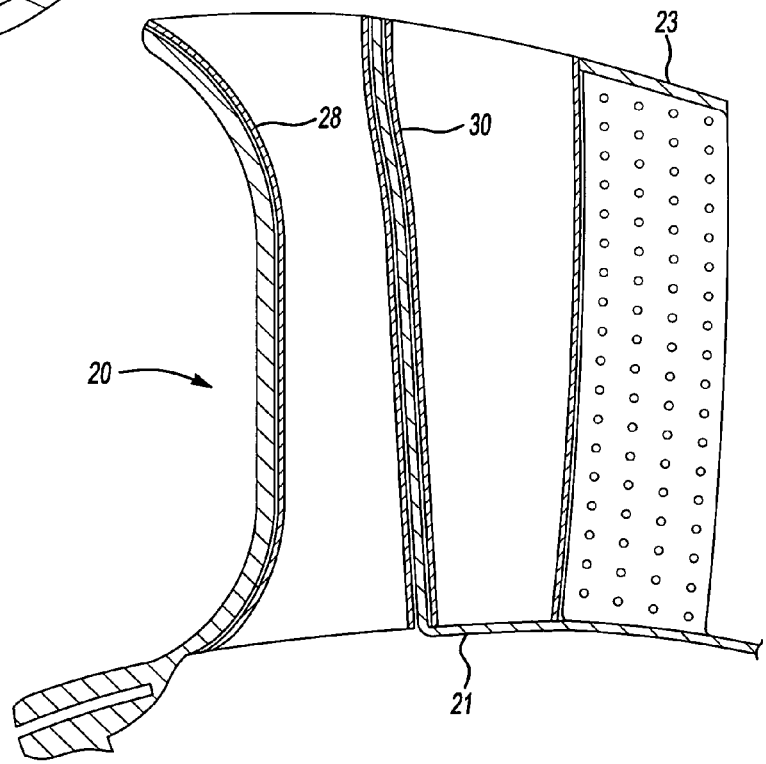
Fig-1C PRIOR ART
FIG. 1C is a view along line 1C-1C from FIG. 1B.

As shown in FIG. 1C, the cooling channels that receive the impingement tubes 28 and 30 extend from an end wall 21 along a length of the airfoil 20 toward a top edge 23. Thus, as shown schematically, cooling air passes into these channels.

Figure 1D:
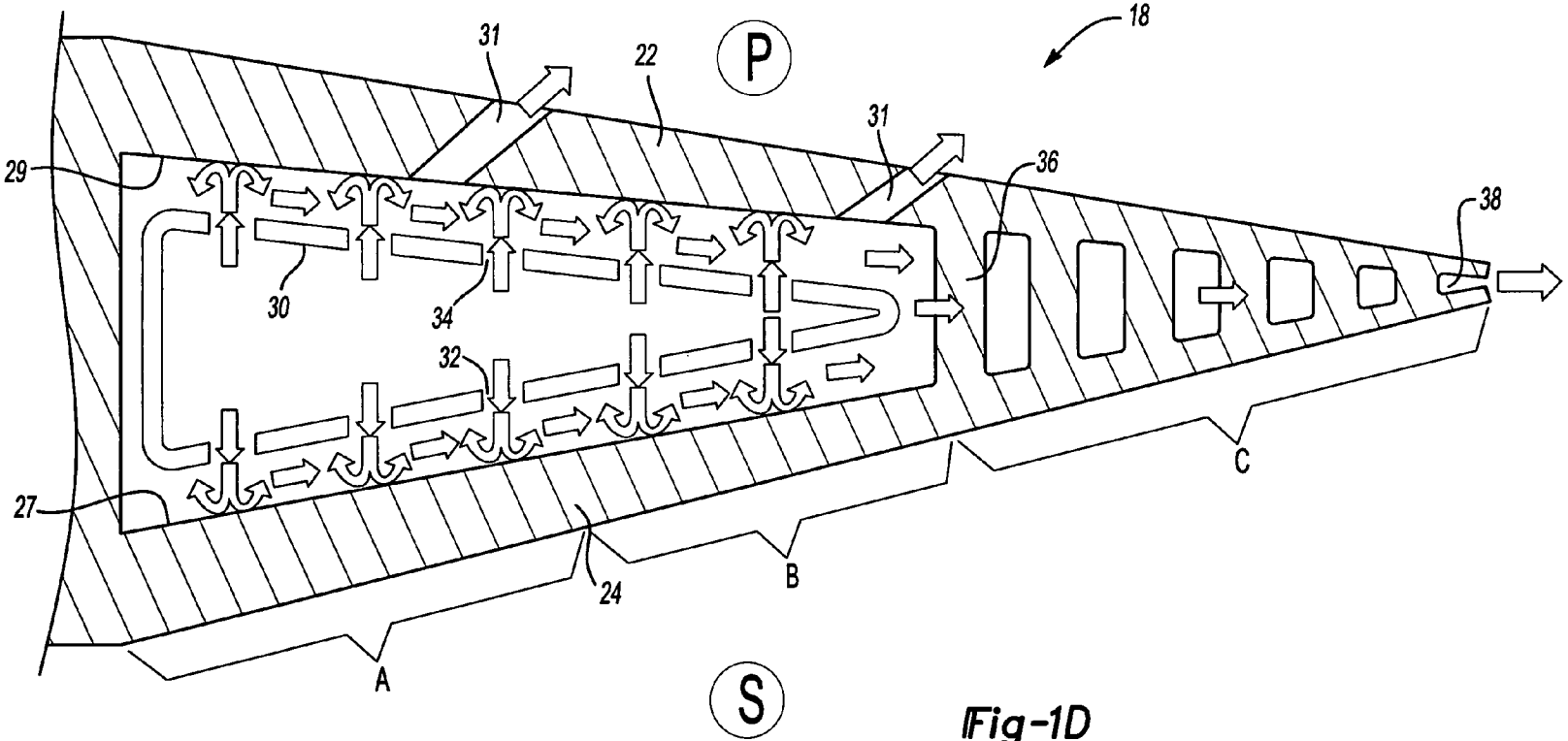
Fig-1D PRIOR ART
FIG. 1D is a schematic view showing cooling of a portion of the prior art vane.

FIG. 1D shows a schematic view of vane 18, to illustrate a problem area. Air having passed outwardly of the impingement holes 32 on the suction side 24 hits an inner wall 27. Similarly, air having passed through the impingement holes 34 on the pressure side 22 hits an inner wall 29. A plurality of areas A, B and C can be defined on the suction side 24. In the area A, there is still a good deal of film cooling provided by the suction side film cooling hole 231 as shown in FIG. 1B. This film cooling in combination with impingement cooling from the impingement holes 32 tends to adequately cool the suction wall in the area A.

Area C is shown as provided with the pedestals 36. As can be appreciated, the pedestals provide a good deal of cooling, and thus area C tends to be adequately cooled also. However, an intermediate area B on the suction side 24 does not always receive adequate cooling. In particular, the film cooling has somewhat degraded on the suction side prior to reaching area B. Thus, area B is provided only with the impingement cooling.

In some applications, this has proven to be inadequate cooling.

In addition to this degradation, the impingement in this region also becomes somewhat ineffective due to "cross-flow degradation." This is the result of the accumulation of coolant that has been injected from earlier regions. As more flow enters the cavity between the tube and the wall and heads toward the trailing edge, the impingement jets begin to become less effective.

In this prior art example, the volume flow of air from the suction side impingement holes 32 which reaches the exit holes at the trailing edge 38 compared to the volume of air having left the impingement holes 34 on the pressure side 22 which reaches the exit holes at the trailing edge 32, is roughly on the order of 2:1. As can also be appreciated, the impingement tube 30 is roughly centered within the channel. Of course, the shape of vane 18 in FIG. 1D is not true to the part (the shape of FIG. 1B is accurate). FIG. 1D is a simplified view to illustrate the flow of cooling air.

Figure 2A:
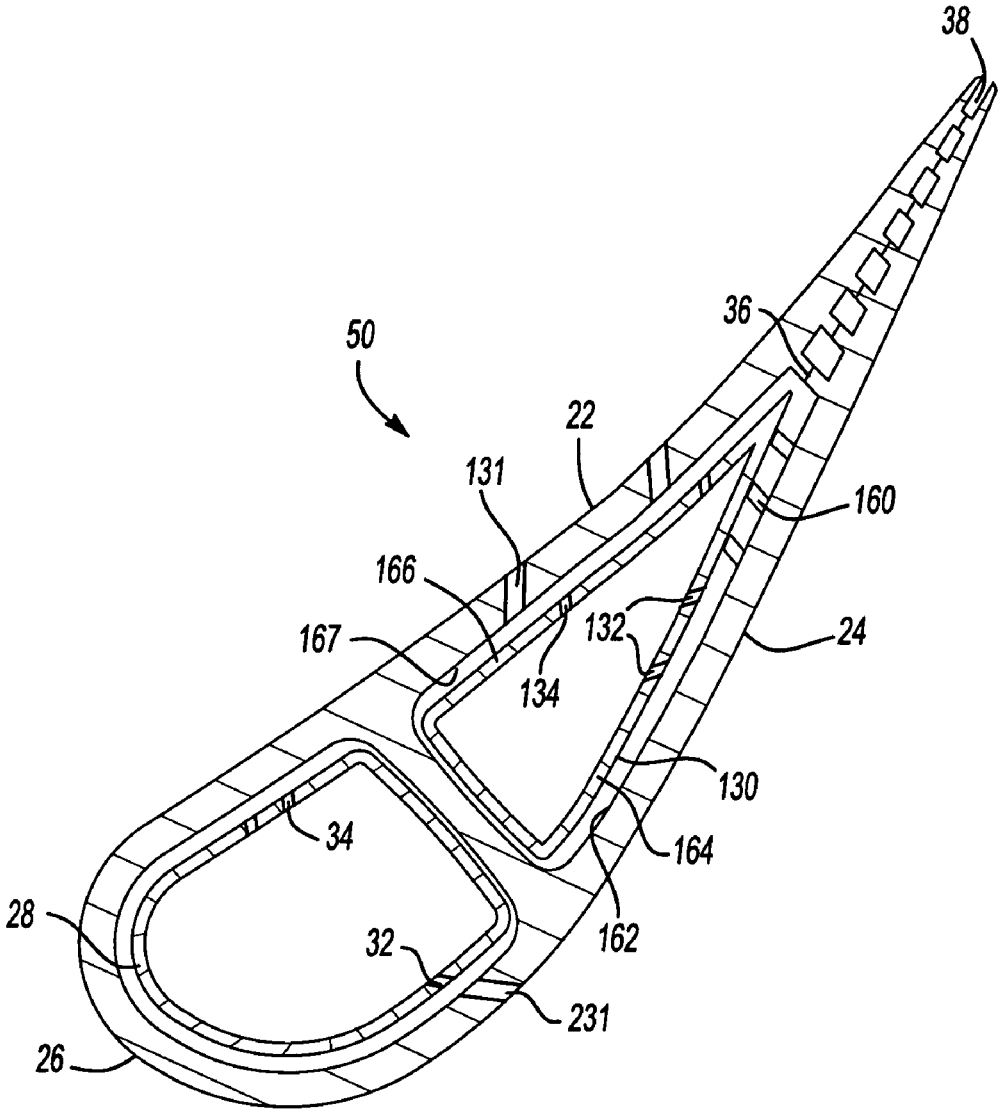
FIG. 2A is a cross-sectional view of an inventive gas turbine vane.

An inventive gas turbine vane 50 is illustrated in FIG. 2A. The tube 130 has impingement holes 132 and 134. The vane 50 has film cooling holes 131 and 231, pedestals 36, and leading and trailing edges 26 and 38, respectively, as in the prior art. However, adjacent to the trailing edge end of the tube 130, there are improvements over the prior art. In particular, pedestals 160 extend from an inner wall 162 on the suction side 24 toward a suction side wall 164 of the tube 130. A wall 166 of the tube 130 facing an inner side of the pressure wall 167 has impingement holes 134 spaced along its entire length. In contrast, the outer wall 164 stops having impingement holes 132 at a location before pedestals 160. While only a few impingement holes are illustrated in the figures of both FIGS. 1B, 1D, 2A and 2B, it should be understood that a good deal of additional holes may be included. Fewer holes are illustrated for the purposes of simplicity of illustration.

Figure 2B:
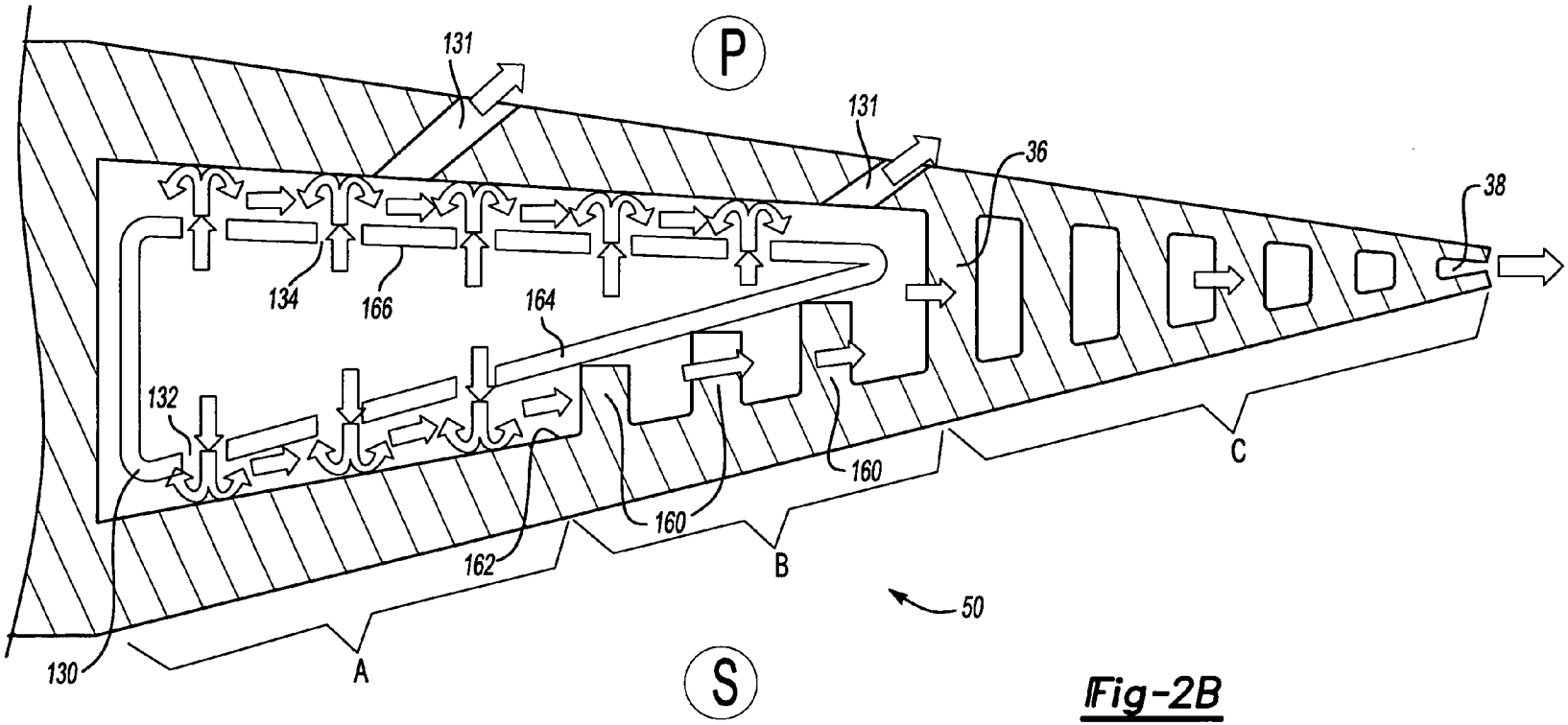
FIG. 2B is a schematic view showing features of the FIG. 2A vane.

FIG. 2B is a highly schematic view, similar to FIG. 1D, and is utilized to illustrate the basic cooling air flow in the inventive turbine component. As can be best seen in FIG. 2B, the pedestals 160 increase in height, since the outer wall 164 is spaced by a greater distance from the inner wall 162 at an end adjacent the trailing edge, than it is spaced in a direction toward the leading edge. This increase in distance ensures the pedestals 160 will be providing increased cross-sectional cooling area for cooling the suction wall in the area mentioned above as being challenging.

One main function of having the pedestals increase in height is to increase convective surface area and increase fin efficiency. This same effect could be achieved with trip strips or dimples. In fact, the term "pedestals" as utilized in this application and in the claims, extends to more than the cylindrical-shaped elements that are illustrated in the drawings of this application. The term "pedestals" would extend to any structure extending outwardly of the wall and into the flow path. The longer pedestals also serve to push the downstream end of the impingement tube toward the pressure side wall. This limits the area in which flow can enter the trailing edge via the pressure side, providing a seal between the two regions. Another function is to allow the suction side flow to diffuse into the trailing edge pedestal bank. This effect "guides" the air into the wider trailing edge cavity and increases static pressure in the transition region. This static pressure increase also helps to seal off the pressure side flow from entering the trailing edge.

Further, the size of the holes 134 and 131 are designed such that the bulk of the air exiting the holes 134 passes through the film cooling holes 131. The air passing through the impingement holes 132 and against the inner wall 162 passes over the pedestals 160, the pedestals 36, and out of the holes at the trailing edge 38. In one disclosed embodiment, the ratio of the volume of air reaching the trailing edge 38 from the suction side impingement holes 132 compared to the pressure side holes 134 is on the order of 10:1.

While the flow ratio in the disclosed embodiment is 10:1, a main focus of this invention is to increase the flow ratio compared to the prior art, which was on the order of 2:1. Thus, flow ratios of 5:1 and greater would come within the scope of this invention. Again, a worker of ordinary skill in the art would recognize how to size the various holes, etc. to achieve this flow ratio.

The increased suction side flow creates a static back pressure limiting the flow from the pressure side. Thus, by sizing the various openings and dimensions to increase the flow from the suction side relative to the pressure side, the invention self-regulates the flow from the pressure side by providing sealing from this back pressure to limit the flow from the pressure side. On the other hand, mechanical seals can also be utilized to further limit the pressure side flow, if desired.

While the invention has been disclosed for use in a vane, other appropriate gas turbine engine components having impingement tube cooling may benefit from this invention. As an example, turbine blades could benefit from this invention. While the invention has application to a wide variety of airfoils in gas turbine engine components, in one disclosed embodiment the invention is utilized as a first stage gas turbine engine vane.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A gas turbine engine component comprising:

a component body extending from a leading edge toward a trailing edge, said component body having an airfoil shape with a pressure side and a suction side;

a cooling channel formed within said component body, and an impingement tube received within said cooling channel, such that cooling fluid may be directed into said impingement tube for passing along a length of said component body and outwardly through impingement holes in said impingement tube, and against an inner wall of both said pressure side and said suction side, said cooling channel having pedestals spaced towards said trailing edge relative to said impingement tube; and supplemental pedestals formed on said inner wall of said suction side and extending toward said impingement tube at an end of said impingement tube spaced toward said trailing edge, and there being impingement holes in a pressure side portion of said impingement tube aligned with said supplemental pedestals, wherein said impingement tube has no impingement holes in a suction side portion of said impingement tube aligned with said supplemental pedestals.

2. The gas turbine engine component as set forth in claim 1, wherein the size of passages are designed such that a ratio of air flow passing outwardly of a suction side of said impingement tube and reaching exit holes in said trailing edge compared to the air flow passing from said pressure side of said impingement tube and reaching said exit holes in said trailing edge is greater than 5:1.

3. The gas turbine engine component as set forth in claim 2, wherein a sealing effect assists in resisting air flow passing from said pressure side of said impingement tube and reaching said exit holes.

4. The gas turbine engine component as set forth in claim 3, wherein said resistance is provided by fluid effects.

5. The gas turbine engine component as set forth in claim 1, wherein said gas turbine engine component is a stationary vane.

6. A gas turbine engine component comprising:

a component body extending from a leading edge toward a trailing edge, said component body having an airfoil shape with a pressure side and a suction side;

a cooling channel formed within said component body, and an impingement tube received within said cooling channel, such that cooling fluid may be directed into said impingement tube for passing along a length of said component body and outwardly through impingement holes in said impingement tube, and against an inner wall of both said pressure side and said suction side, said cooling channel having pedestals spaced towards said trailing edge relative to said impingement tube;

supplemental pedestals formed on said inner wall of said suction side and extending toward said impingement tube at an end of said impingement tube spaced toward said trailing edge; and a second cooling channel is spaced toward said leading edge from said cooling channel, and said second cooling channel also receiving an impingement tube and a film cooling hole being formed in a wall at said suction side to receive air from said second cooling channel.

7. A gas turbine engine component comprising:

a component body extending from a leading edge toward a trailing edge, said component body having an airfoil shape with a pressure side and a suction side;

a cooling channel formed within said component body, and an impingement tube received within said cooling channel, such that cooling fluid may be directed into said impingement tube for passing along a length of said component body and outwardly through impingement holes in said impingement tube, and against an inner wall of both said pressure side and said suction side, said cooling channel having pedestals spaced towards said trailing edge relative to said impingement tube;

supplement pedestals formed on said inner wall of said suction side and extending toward said impingement tube at an end of said impingement tube spaced toward said trailing edge; and said supplemental pedestals increase in height in a direction measured from said leading edge toward said trailing edge.

8. The gas turbine engine component as set forth in claim 7, wherein a distance between said inner wall and said impingement tube at said suction side increases as the impingement tube extends from the leading edge toward the trailing edge.

9. The gas turbine engine component as set forth in claim 8, wherein a distance measured between said inner wall and said impingement tube at said pressure side remains relatively constant as the impingement tube extends from the leading edge toward the trailing edge.

10. A turbine engine comprising:

a combustion section;

a turbine section including a turbine rotor rotating about an axis; and at least one component of the turbine engine having a component body extending from a leading edge toward a trailing edge, said component body having an airfoil shape with a pressure side and a suction side, a cooling channel formed within said component body, and an impingement tube received within said cooling channel, such that cooling fluid may be directed into said impingement tube for passing along a length of said component body and outwardly through impingement holes in said impingement tube, and against an inner wall of both said pressure side and said suction side, said cooling channel having pedestals spaced towards said trailing edge relative to said impingement tube;

supplemental pedestals formed on said inner wall of said suction side and extending toward said impingement tube at an end of said impingement tube spaced toward said trailing edge; and said supplemental pedestals increase in height in a direction measured from said leading edge toward said trailing edge.

11. The turbine engine as set forth in claim 10, wherein said impingement tube has no impingement holes in a suction side portion of said impingement tube aligned with said supplemental pedestals.

12. The turbine engine as set forth in claim 10, wherein the size of said passages are designed such that a ratio of air flow passing outwardly of a suction side of said impingement tube and reaching exit holes in said trailing edge compared to the air flow passing from said pressure side of said impingement tube and reaching said exit holes in said trailing edge is 5:1.

13. The turbine engine as set forth in claim 12, wherein a sealing effect assists in resisting air flow passing from said pressure side of said impingement tube and reaching said exit holes.

14. The turbine engine as set forth in claim 13, wherein said resistance is provided by fluid effects.

15. The turbine engine as set forth in claim 10, wherein a second cooling channel is spaced toward said leading edge from said cooling channel, and said second cooling channel also receiving an impingement tube and a film cooling hole being formed in a wall at said suction side to receive air from said second cooling channel.

16. The turbine engine as set forth in claim 10, wherein a distance between said inner wall and said impingement tube at said suction side increases as the impingement tube extends from the leading edge toward the trailing edge.

17. The turbine engine as set forth in claim 16, wherein a distance measured between said inner wall and said impingement tube at said pressure side remains relatively constant as the impingement tube extends from the leading edge toward the trailing edge.

18. The turbine engine as set forth in claim 10, wherein said component is a stationary vane.

* * * * *